US010640881B2

(12) United States Patent
Logan et al.

(10) Patent No.: US 10,640,881 B2
(45) Date of Patent: May 5, 2020

(54) ELECTROPLATING RACK

(71) Applicant: Saporito Finishing Company, Cicero, IL (US)

(72) Inventors: Jeff Logan, Lombard, IL (US); Jeff Rice, Lockport, IL (US)

( * ) Notice: Subject to any disclaimer, the term of this patent is extended or adjusted under 35 U.S.C. 154(b) by 97 days.

(21) Appl. No.: 15/229,475

(22) Filed: Aug. 5, 2016

(65) Prior Publication Data

US 2017/0037529 A1 Feb. 9, 2017

Related U.S. Application Data

(60) Provisional application No. 62/201,423, filed on Aug. 5, 2015.

(51) Int. Cl.
*C25D 17/08* (2006.01)

(52) U.S. Cl.
CPC ..... *C25D 17/08* (2013.01)

(58) Field of Classification Search
CPC ..... C25D 17/06; C25D 17/08
USPC ..... 204/297.04
See application file for complete search history.

(56) References Cited

U.S. PATENT DOCUMENTS

| | | | | | |
|---|---|---|---|---|---|
| 2,362,474 | A * | 11/1944 | Elsenheimer | C25D 7/04 | 204/297.04 |
| 2,722,513 | A * | 11/1955 | Clark | C25D 17/06 | 204/297.04 |
| 3,294,668 | A * | 12/1966 | Belke | C09C 3/08 | 204/297.1 |
| 3,901,788 | A * | 8/1975 | Schaer | C25D 7/04 | 204/222 |
| 4,746,416 | A * | 5/1988 | Jacob | C25D 17/06 | 118/428 |
| 9,809,899 | B2 * | 11/2017 | Herdman | C25D 17/08 | |
| 2013/0186345 | A1 * | 7/2013 | Leslie | A01K 61/54 | 119/240 |

* cited by examiner

*Primary Examiner* — Alexander W Keeling
(74) *Attorney, Agent, or Firm* — Akerman LLP

(57) ABSTRACT

A rack for supporting work pieces during electroplating including a frame having respective first and second side portions and top and bottom portions, the first and second sides attached to each other through top and bottom portions; one or more support arms extending between the frame first and second sides, the one or more support arms affixed to the frame to allow rotational movement of the one or more support arms; one or more clips affixed to the support arms, the one or more clips configured to hold a work piece; and a buoyant device affixed to the one or more support arms.

16 Claims, 7 Drawing Sheets

ELECTROPLATING RACK

CROSS-REFERENCE TO RELATED APPLICATIONS

This application claims priority to U.S. Provisional Patent Application No. 62/201,423, filed on Aug. 5, 2015, which is incorporated herein by reference in its entirety.

FIELD OF THE INVENTION

The Invention relates generally to electroplating equipment and processes. More specifically, the invention relates to assemblies which may be used in electroplating processes to further the immersion and plating of work pieces in the plating bath.

BACKGROUND

The technology of electroplating is well known. Electroplating or electro deposition involves the immersion of a cathode and anode in an electrolyte. With the application of a current to the anode, metal salts within the electrolyte are reduced at the electrolyte—cathode interface and plate out onto the cathode.

Electroplating is most commonly used to change the surface properties of a work piece. Physical properties such as strength, wear and abrasion resistance, resistance to ambient conditions such as temperature extremes and impact can all be affected by the deposition of adjunct metal coatings to the work piece. Other properties such as lubricity and corrosion resistance, may also be affected by electroplating. Electroplating is also commonly used to affect the aesthetic properties of a work piece through the application of a more preferred surface coating onto the object.

The literature is replete with electroplating processes and devices which have been used previously. Examples of devices and processes include those disclosed by Oliver in U.S. Pat. No. 1,533,805 as an electroplating rack which addresses the routine problem of hangers being coated and needing cleaning. Oliver discloses hangers which may be removed and replaced during cleaning so as to avoid down time in the plating process. Davis U.S. Pat. No. 2,484,079 discloses a hydraulically operated plating machine intended to avoid many of the concerns which arose with chain driven plating apparatus. Similar to Oliver, Belke, U.S. Pat. No. 2,820,757, discloses a plating rack assembly. The Belke plating rack is intent on maintaining low electrical resistance connections between the rack and the articles to be electroplated through assembly, plating, and disassembly. Henson, U.S. Pat. No. 2,898,285 also addresses the concern of errant metal deposits on the electroplating rack by the use conductive elements placed on the rack.

Novitsky, U.S. Pat. No. 3,314,877 discloses a plating and anodizing rack having a cylindrical shape. Chenevier, U.S. Pat. No. 3,607,707 also addresses the corrosivity of the plating process and the effect on the racks used therein. Fueki et al., U.S. Pat. No. 3,939,056 discloses an electroplating rack which is intended to reduce the amount of plating build up on the rack. The evident problem is that the buildup of deposits on the plating rack is a waste of material, and inevitably takes the rack out of service to be cleaned. Without cleaning, plating will further erode the structural integrity of the rack over time.

Of the problems addressed in the technical field of electroplating, one concern is the consistent and thorough cleaning of the work piece prior to the plating process as well as consistent and thorough electro deposition during the plating process.

Work pieces come in many sizes, shapes and with many different points of detail, patterning and design. Depending on the purpose of the deposition, the plating coverage of the work piece can be critical. Further coverage of the work piece is not always easy or intuitive.

Work pieces with a high level of detail can offer concerns over the permeation of the plating bath into the points of detail. Work pieces having walls that extend outwardly from a closed bottom (for example having the shape of a cup), are also one further design that may present problems with cleaning and plating.

Conventional plating processes such as those disclosed above, place the work piece in the plating bath through an up and down motion. While extended time in the bath can overcome certain concerns of the bath permeating the definition of the work piece, practical limitations abound.

Examples of recent attempts at plating racks and assemblies include Patent Application Publication US 2002/0179438 which discloses a plating clamp assembly intended to selectively clamp a work piece and thus allow for selective coating of the work piece.

U.S. Pat. No. 7,850,830 discloses a plating rack having a cylindrical central portion which moves through mechanical action to, in turn, move work pieces through the plating bath.

Patent Application Publication US 2014/0076720 discloses an electro polishing fixture with a lever arm intended to maintain electrical connection and reposition.

Seemingly self-evident, cleaning and then plating is easier to discuss than do. The submersion of a fixed piece in a stationary position on conventional racks does not always allow for penetration of cleaning solution into cracks and crevices of the work piece. Varying patterns as well as shapes and designs present concerns that often leave individual work pieces either partially cleaned or partially plated, making the work piece less than acceptable for application into the intended environment of use.

Despite these advances, further work needs to be done to reposition or reorient work pieces in the plating bath to accommodate penetration or permeation of the bath into the definition of the work piece. Thus there is a need to solve these and other problems found in the art.

SUMMARY OF THE INVENTION

In accordance with one aspect of the invention, there is provided a rack for use in electroplating; one or more support arms, wherein the one or more support arms rotate around the axis of the one or more support arms; one or more clips affixed to the one or more support arms, wherein the one or more clips moves rotationally when the one or more one or more support arms rotate; and a device affixed to the one or more support arms, wherein the device causes said one or more support arms to rotate.

In accordance with a further aspect of the invention, there is provided a rack for supporting work pieces during electroplating having a frame with respective first and second side portions and top and bottom portions, the first and second sides attached to each other through top and bottom portions; one or more support arms extending between the frame first and second sides, the one or more support arms affixed to the frame to allow rotational movement of the one or more support arms; one or more clips affixed to the support arms, the one or more clips configured to hold a work piece; and a buoyant device affixed to one or more support arms.

The invention is a rack for submersing work pieces or parts into plating baths. The design of the rack provides definite economies and efficiencies in the overall plating process. As noted in the literature cited above, optimal plating comes with low contamination between baths, cooler temperatures, and higher current densities.

The use of clips used for affixing the work pieces to be plated to the frame, the clips having a certain composition and thickness, allows for faster and higher quality plating due to higher current densities. The combined effect of the pattern of the clips and the articulating—pivoting—motion of the support arms also allows for more effective cleaning of the individual work pieces prior to plating and more effective plating during the actual processing. The articulating motion of the support arms also allows for better draining of the work pieces after submersion.

By combining articulation of the support arms and the provision of better contact points through the clips described herein, the plating rack of the invention heightens conductivity and in turn, lowers energy thereby increasing the efficiency of cleaning and plating processes.

DETAILED DESCRIPTION OF THE PREFERRED EMBODIMENTS

Figure 1:
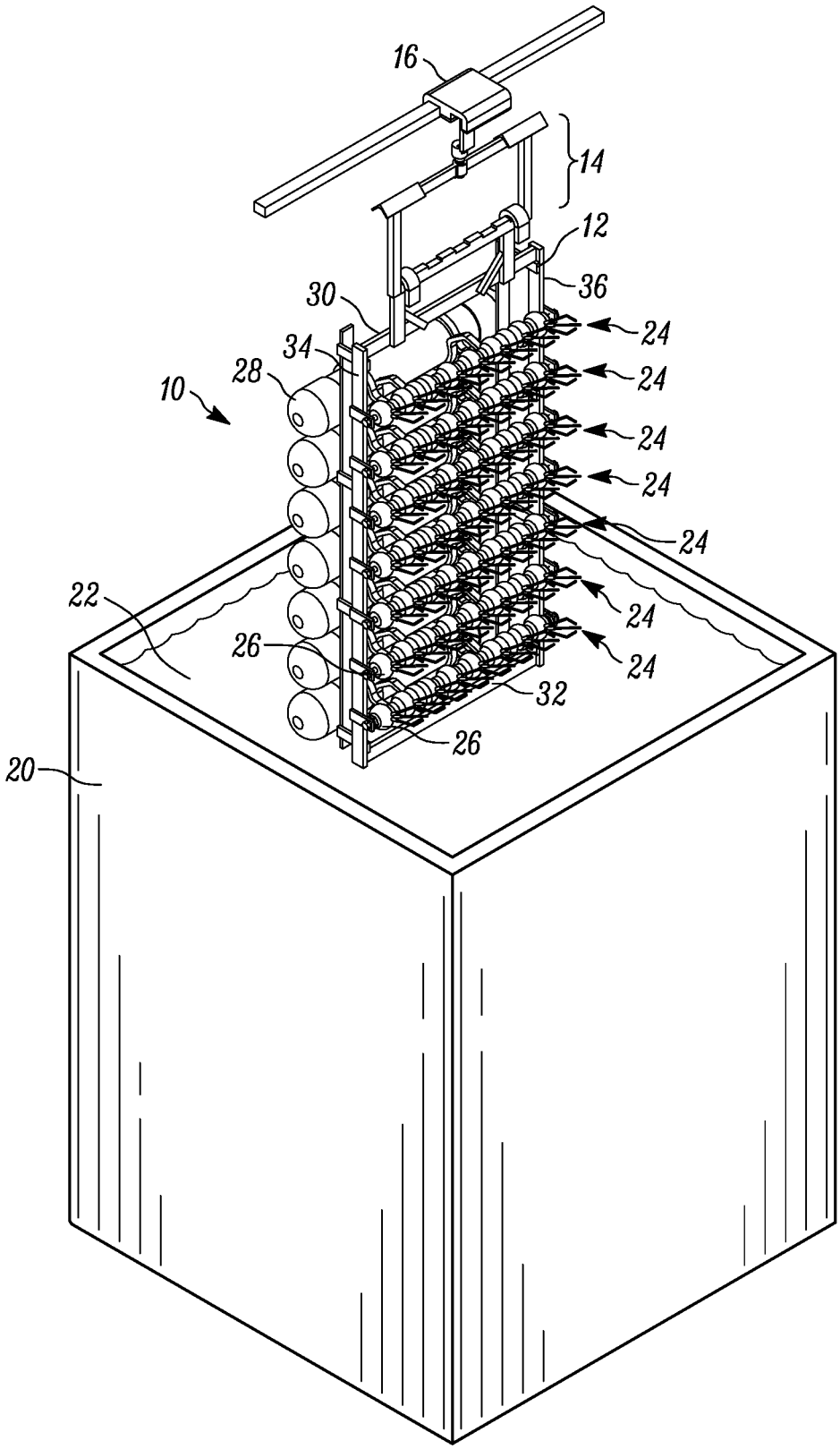
FIG. 1 is a perspective view of one embodiment of the invention shown in use in one exemplary plating bath.

Turning to the Figures wherein like parts are designated with like numerals throughout several views, an electroplating rack 10 is shown in its environment of use in FIG. 1. The electroplating rack generally has frame 12 having a first and a second side portion joined through a top and bottom. The rack 12 may have one or more support arms 26 which are mounted on the frame 12. As can be seen in FIG. 1, clips 24 are affixed to the first side of the support arms 26 with buoyant devices 28 affixed to the second side of the support arms 26.

As noted above, the electroplating rack generally comprises an exterior frame. The frame functions to support support arms 26 which, in turn, hold parts 50 to be anodized (see FIGS. 4 and 5) through clips 24. Generally the frame may take any size in accordance with the invention. More preferably, as can be seen in FIG. 1, one embodiment of the frame is rectangular with top 30 and 32 bottom portions joined by first 34 and second 36 sides.

The first 34 and second 36 sides may generally be configured to attach the support arms 26 to the frame. The frame also preferably facilitates the plating process. The top portion of the rack generally includes hangers 14 attached to a conveyor 16 which will allow the rack to be submersed and raised in the series of baths used for the plating process. The bottom of the rack 32 may be closed with a bottom portion or left open. One of skill in the art having read this specification will appreciate that plating processes generally proceed through a number of baths 20, as shown in FIG. 1.

Alternatively, the first 34 and second 36 sides may be supported by intermediate supports placed intermittently down the length of, and between, the first 34 and second 36 sides. In a further alternative embodiment, the first 34 and second 36 sides may be affixed to the support arms in a manner which allows full use of the rack 10 of the invention but without any further supporting structure between the first 34 and second 36 sides. To this end, in this embodiment of the invention, the support arms 26 are suspended between the first and second sides in a manner which allows for the hanging of the rack from the conveyor as it proceeds through the plating process and for free rotation of the support arms during the cleaning and plating process.

Figure 3B:
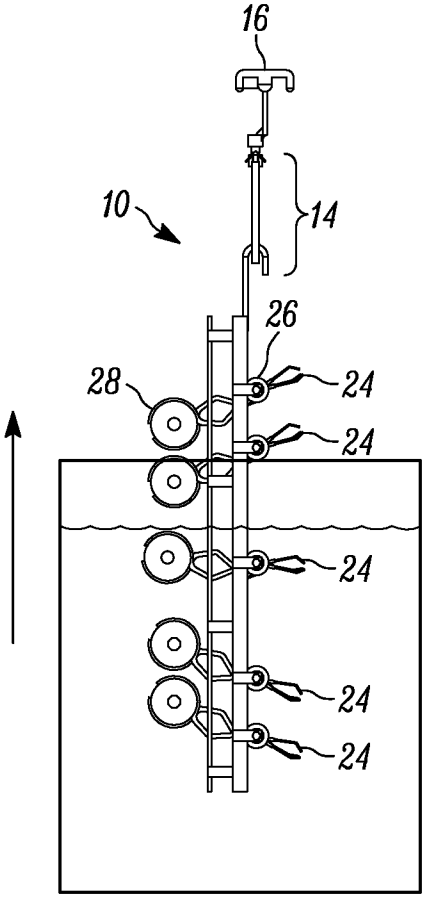
FIG. 3B is a partial cutaway view of one embodiment of the invention shown in FIG. 2 being removed from the bath.
Figure 3A:
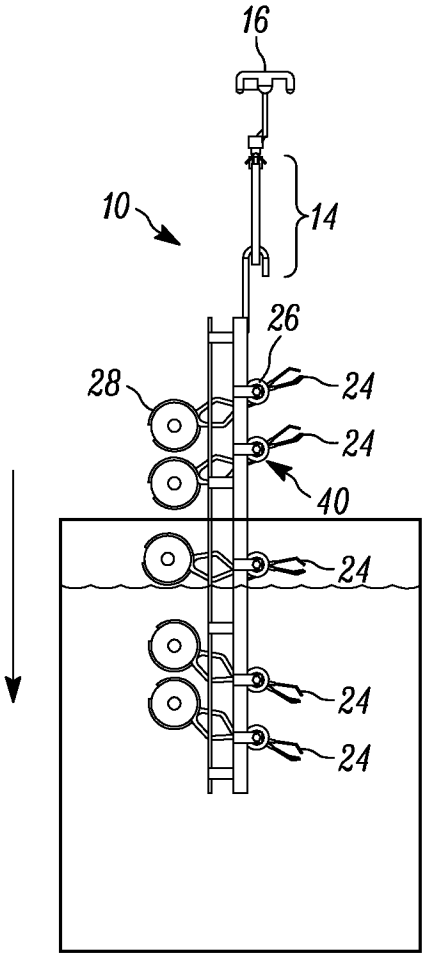
FIG. 3A is a partial cut away view of one embodiment of the invention shown in FIG. 2 being introduced into the bath.
Figure 2:
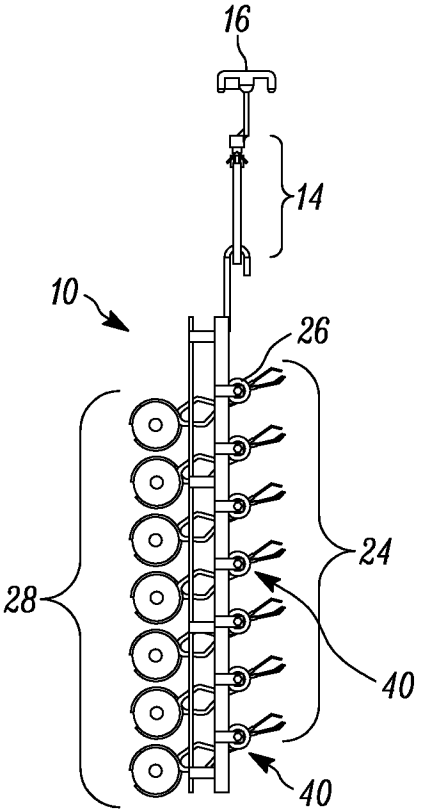
FIG. 2 is a side plan view of one embodiment of the invention as shown in FIG. 1 outside of the context of an exemplary plating bath.

The support arms 26 function to hold and support the work pieces intended to be plated during the plating process. In accordance with the invention, the support arms are configured to rotate as the rack is submersed in the individual plating baths 20, as shown in FIGS. 2 and 3. In a preferred embodiment, the support arms 26 are provided with a protective coating which prevents the buildup of corrosion due to the combined effect of built up salts and other contaminants. The protective coating may be added to the support arms 26 via dip coating. In certain preferred embodiments the support arms 26 are dip coated with the protective coating at least twice. The thickness of the protective coating may range from 0.1 inches to 0.5 inches, and preferably 0.111 inches to 0.444 inches, and more preferably from 0.125 inches to 0.25 inches. In a preferred embodiment the thickness of the protective coating is 0.125 inches. In a more preferred embodiment, the thickness of the protective coating is 0.25 inches. Further, in a preferred embodiment the protective coating comprises plastisol. Plastisol is generally a polymeric coating material, for example a suspension or solution of polymers, such as a suspension of polyvinylchloride (PVC) particles, in a liquid plasticizer. One exemplary plasticizer is phthalate esters. Other exemplary plasticizers include trimellitates, adipates, sebacates, maleates, benzoates, terphthalates, 1,2-Cyclohexane dicarboxylic acid diisonyl ester, epoxidized vegetable oils, alkyl sulphonic acid phenyl ester, sulfonamides, organophosphates, glycols/polyethers, polybutene, acetylated monoglycerides, and alkyl citrates. Manufacturers of plastisol include but are not limited to Plastisol Industrial Co., Ltd., Loes Enterprises, Inc. and BASF.

Figure 4:
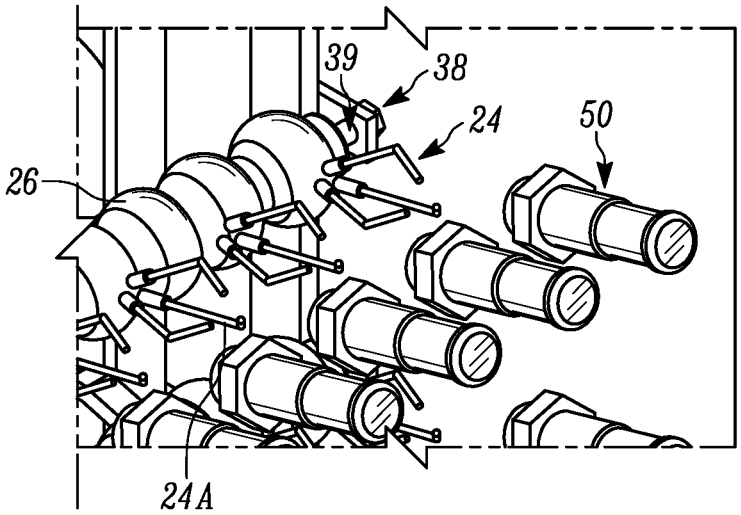
FIG. 4 is a partial exploded perspective view of one embodiment of the invention illustrating a part to be plated being inserted onto the supporting clips of the rack of the invention.

Further, the support areas 26 are suspended between the rack first 34 and second 36 sides to swivel or articulate allowing movement of the clips 24 and, in turn, the work pieces 50. Preferably, the movement is rotational around the axes of the support arms 26. One manner of suspending or attaching support arms 26 to the rack 10 of the invention is by bolting the support arms 26 with one or more bolts 38 to hole 39 found on rack first 34 and second 36 sides, as shown in FIG. 4. The bolts 38 and rack first 34 and second 36 sides may be configured or shaped in any manner which is consistent with this function. Preferably, bolts 38 are threaded and the rack first 34 and second 36 sides are configured to receive threaded bolt 38. This may be accomplished via hole 39 having threads which correspond to threaded bolt 38, or a threaded nut 41 (not shown) may be welded to the hole 39.

Preferably, a bolt 38 is inserted such that the head of a bolt 38 is not flush against hole 39 or nut 41. Rather, in a preferred embodiment a portion of the shank or thread of the bolt 38 is left exposed. This allows the support arms 26 to move laterally with respect to the rack first 34 and second 36 sides, allowing better stacking where multiple support arms 26 are utilized.

We have found that throughout the plating process, a critical aspect to the process is cleaning and then plating the individual parts as intended. Important to cleaning is completely contacting the internal and external surfaces of the individual work pieces with cleaning solution to remove any contaminating matter from these exterior and interior surfaces. This prevents the buildup of corrosion due to the combined effect of built up salts and other contaminants on the raw work piece (prior to plating) and contact with the various constituents of the baths 20 during the plating process. Important to plating is properly plating the individual work piece so that the entirety of the work piece is coated.

In accordance with the invention, the support arms 26 comprise clips 24 affixed thereto and extending from one side of the rack 10. The rack 10 also comprises a buoyant device 28 which creates movement or articulation also attached to the support arm 26 and extending from the support arm 26, as shown in FIG. 2. The clips 24 function to affix or hold the work pieces to the support arms 26. The clips 24 may be configured and shaped in any manner which is consistent with this function. Preferably the clips 24 are configured to fit within the inner surfaces of the work piece to be plated, as shown in FIGS. 4 and 5.

Placement of the work piece on the clips has traditionally been through attachment to an outer surface on the work piece, Attachment to the outer surface often resulted in areas on the outer or exterior surface which were left unplated. Other concerns raised by clipping the exterior of the work piece 50 is a loss of conductivity and having parts fall off of the rack into the bath 20.

Figure 5:
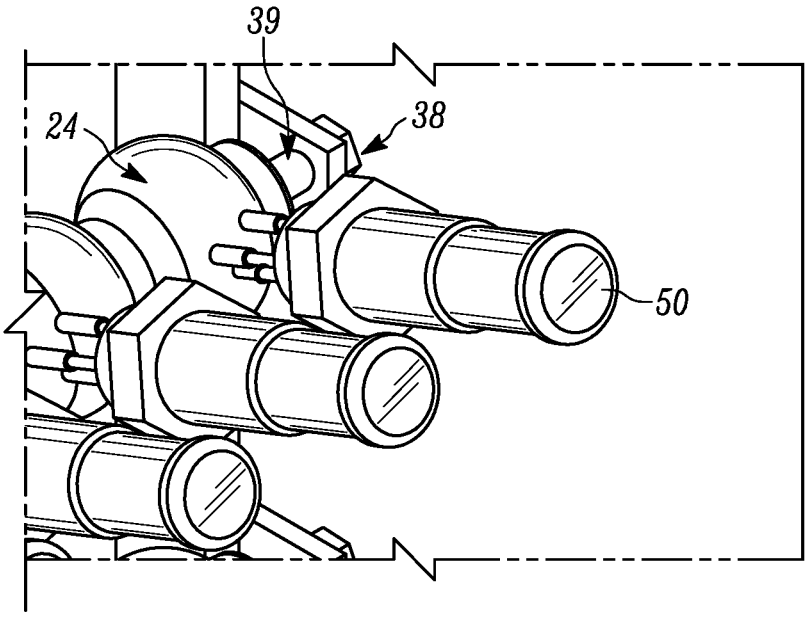
FIG. 5 is a partial perspective view of one embodiment of the invention illustrating the part to be plated on the supporting clips of the rack of the invention.

In accordance with the invention the clips 24 are configured to fit within the inner diameter of the work piece 50 and thereby leave the exterior surface of the work piece 50 untouched and fully plated, as shown in FIGS. 4 and 5. One exemplary design which is consistent with the invention may be seen in FIG. 4. As is illustrated, the clips 24 may be configured to bend inwardly to avoid contact of the internal cavity of the work piece 50 by the ends 24A (FIG. 4) of the individual clips. This allows the work piece 50 to be held while simultaneously avoiding damage to the internal portions of the work piece 50. The clips 24 used with the rack of the invention provide certain benefits. Apart from avoiding areas in the work piece 50 which are either unplated or otherwise damaged, holding the individual work pieces 50 by their internal surfaces provides a much more secure fixture of the work piece 50 to the supporting arm. More secure attachment of the work piece 50 reduces the loss of parts into the plating bath 20 and, in turn, the reduction of contamination of these various baths 20 by the work piece 50. The clips 24 may be angled, patterned or bent in a manner in which the ends of the clips 24A, do not touch the interior walls of the work piece, as shown in FIG. 4.

The clips 24 may comprise any composition which allows conductive plating to take place on the work piece 50. Representative compositions include phosphor bronze, steel, hardened steel, and stainless steel 300 series or non-magnetic stainless steel. The thickness of the clips may range from 0.050 inches to 0.250 inches and preferably 0.088 inches to 0.098 inches. One preferred material is stainless steel 300 (magnetic) in a thickness of about 0.093 inches. Generally, this thickness in the clips is preferred as it provides support for the work pieces 50 and better conductivity during plating.

Figure 6A:
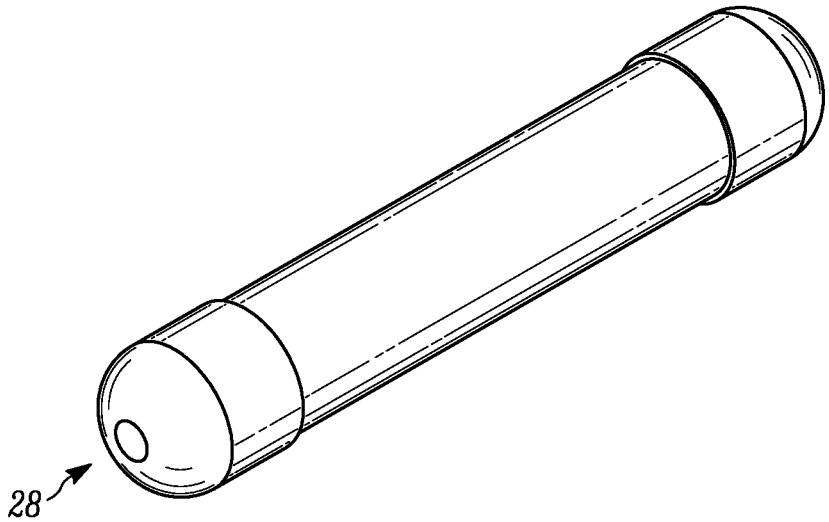
FIG. 6A is a perspective view of an exemplary buoyant device.
Figure 6B:
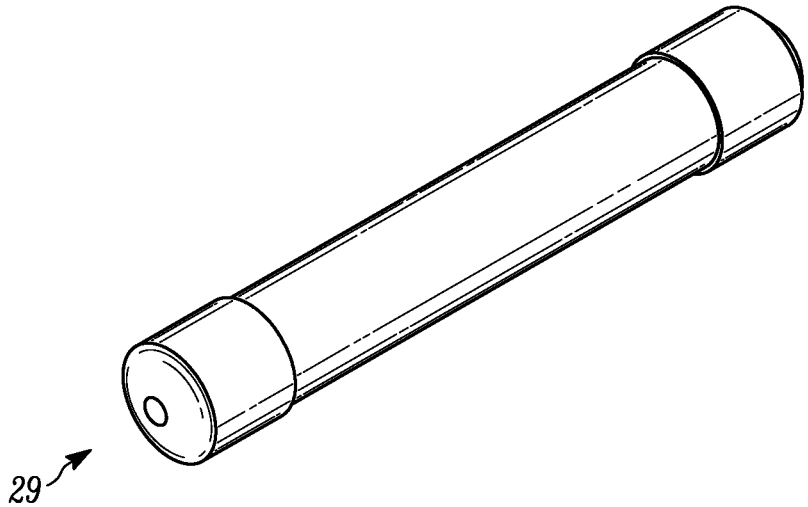
FIG. 6B is a perspective view of an alternative exemplary buoyant device.

Also attached to the support arm 26 is a buoyant device 28 which creates rotational movement or articulation in the support arm 26. The movement is rotational around the axis of attachment 40 of the support arm 26, such that the buoyant device 28, support arm 26 and work piece 50 form a lever. Any number of devices which will create this movement may be used in accordance with the invention. Preferably a structure which is buoyant in the various cleaning and plating baths 20 may be used. One preferred structure that we have found useful is a polymeric plastic cylinder buoyant device 28 filled with a gas such as air, nitrogen or the like, as shown in FIGS. 1 and 2. In a preferred embodiment buoyant device 28 has dimensions of 15.5 inches by 2 inches. In a preferred embodiment, the ends of the buoyant device 28 have a dome shape, as shown in FIGS. 1 and 6A. In a more preferred embodiment, the ends of buoyant device 28 have a truncated dome shape, as shown in FIG. 6B. It has been determined that the truncated dome shape shown in FIG. 6B minimizes the drag on the buoyant device 28 as it enters the plating bath 20, allowing the support arm 26 to freely pivot as the rack 10 is submerged in the plating bath 20.

As can be seen in FIGS. 4 and 5, in use we have found that the weight of the buoyant device 28 holds the support arm in a position with the clips 24 held upward enabling easy fixture of the intended work piece 50 to the clips. Upon submersion, the buoyant device 28 is forced upward as it makes contact with the bath fluid, as shown in FIG. 3. This causes the work piece 50 to be cleaned and plated to rotate or move in relationship to the rack 10 and bath 20. Moving the work piece 50 through the bath 20 in this manner allows the bath fluid to reach and contact the work piece thereby covering the areas of the work piece 50 submersed in the bath 20.

As the rack of the invention is removed from the individual baths, the force of the fluid against the buoyant device 28 forces the buoyant device 28 down and, in turn, the clips 24 up. This action, in turn, moves the work piece once again. With this reorientation, the work piece 50 once again is exposed at different angles to the fluid of the bath 20 thus allowing an additional opportunity for exposure of the surfaces of the work piece 50 to the bath fluid.

Figure 7:
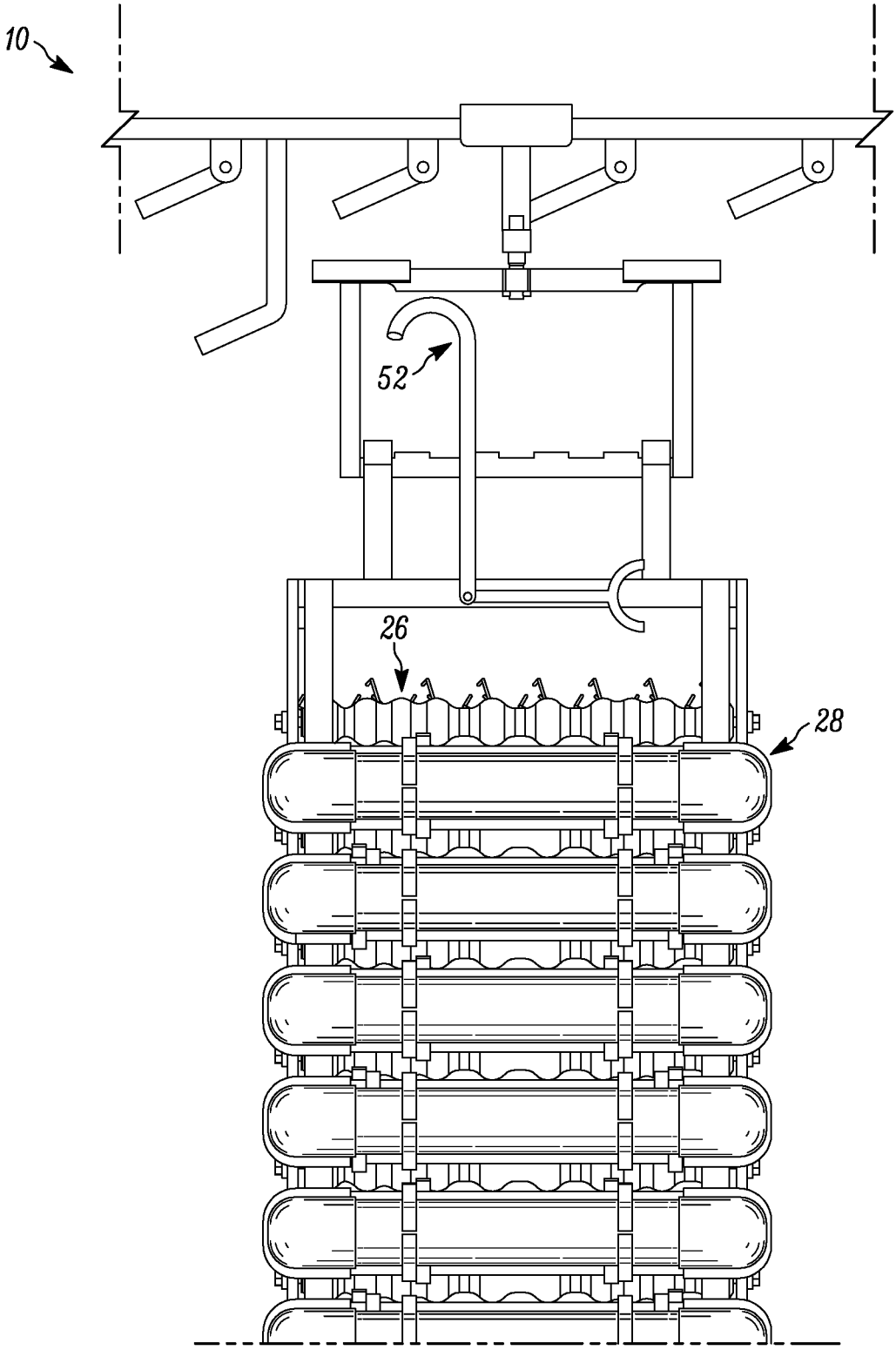
FIG. 7 is a perspective view of one embodiment of the invention depicting a locking bar.

In certain embodiments, it is desirable for the support arm 26 to have freedom of movement in one bath, and to be restrained in other baths. As such a locking bar 52 as disclosed in FIG. 7 may be included at the top of rack 10. Locking bar 52 is attached to rack 10 such that it may pivot from a raised position to a lowered position. When locking bar 52 is in its raised position, support arm 26 may move unimpeded. In contrast, when locking bar 52 is in its lowered position, support arm 26 is prevented from moving. Locking bar 52 may be manually actuated or may be actuated via motors, springs, hydraulics, pneumatics or the like. Where multiple support arms 26 are utilized, support arms 26 can be arranged such that movement of one support arm 26 is dependent upon movement of the support arm 26 above it. As such, if the locking bar 52 immobilizes the top most support arm 26, all subsequent support arms 26 are immobilized as well.

Figure 8:
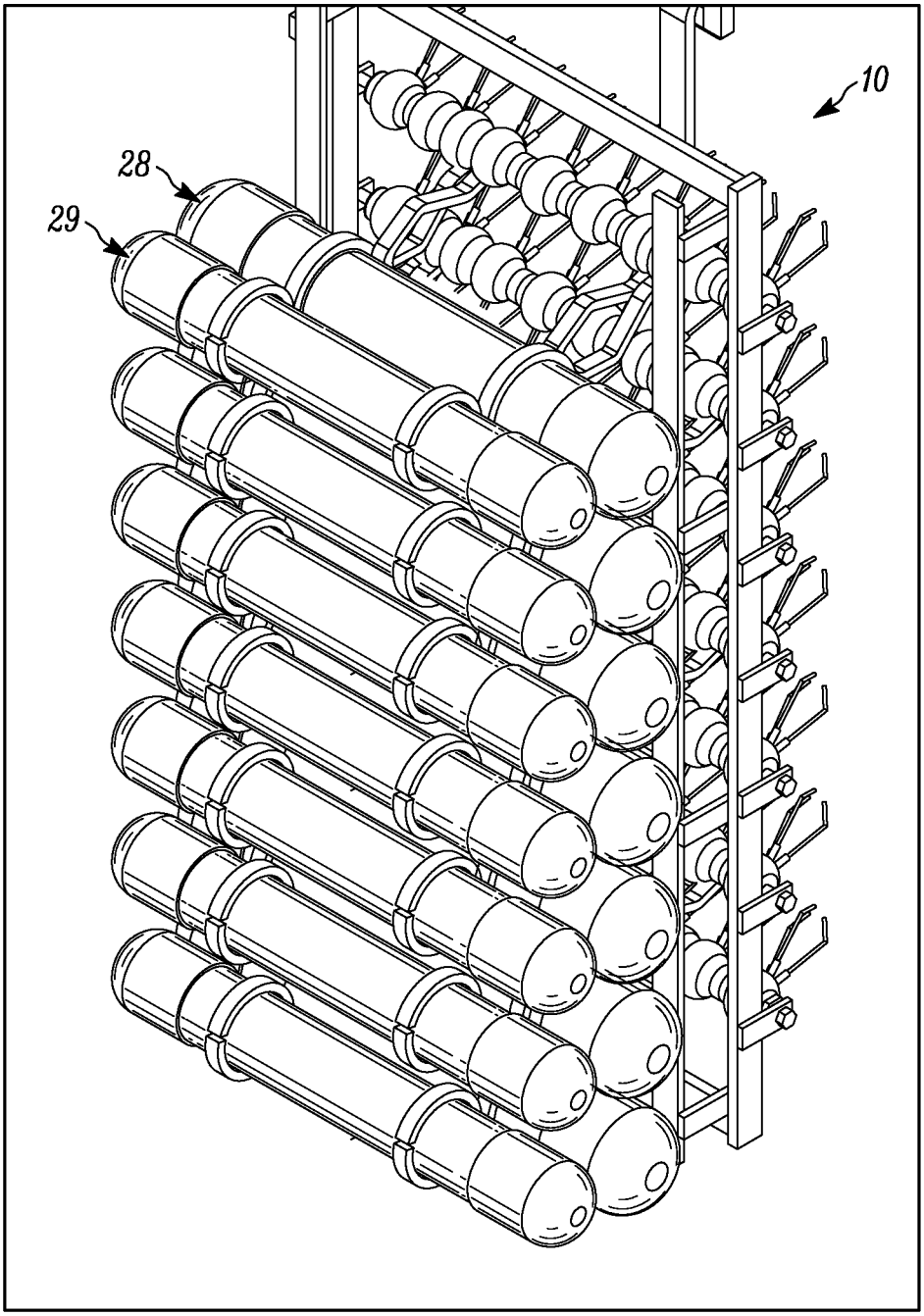
FIG. 8 is a perspective view of one embodiment of the invention depicting an additional buoyant device removably attached to a buoyant device.

We have found that the weight and length of the work piece 50 affects the ability of the buoyant device 28 to move the support arm 26 up and down in the plating bath 20. Specifically, a work piece 50 which is extraordinarily heavy or long may change the center of gravity of the lever formed by the buoyant device 28, support arm 26 and work piece 50, such that the work piece 50 is not adequately exposed to the fluid of plating bath 20. In such instances one or more additional buoyant devices 29 may be attached to the buoyant device 28 to correct the center of gravity. Like buoyant device 28, additional buoyant device 29 is preferably a polymeric plastic cylinder. Further, in a preferred embodiment the additional buoyant device 29 has dimensions of 15.5 inches by 1 inch. Additionally, in a preferred embodiment, the ends of additional buoyant device 29 may have a dome shape, like buoyant device 28. In a more preferred embodiment, the ends of additional buoyant device 29 may have a truncated dome shape. An additional buoyant device 29 may be attached to buoyant device 28 by way of a dual C-clamp 54 as depicted in FIG. 8. Alternatively, the additional buoyant device 29 may be removably attached to buoyant device 28 via a clamp, bolt, screw, hook, tie or the like. Multiple additional buoyant devices 29 may be attached, either to buoyant device 28 directly or to one another in series. As such, the invention provides a modular means of modifying the center of gravity of the lever formed by the buoyant device 28, support arm 26 and work piece 50.

Figure 9:
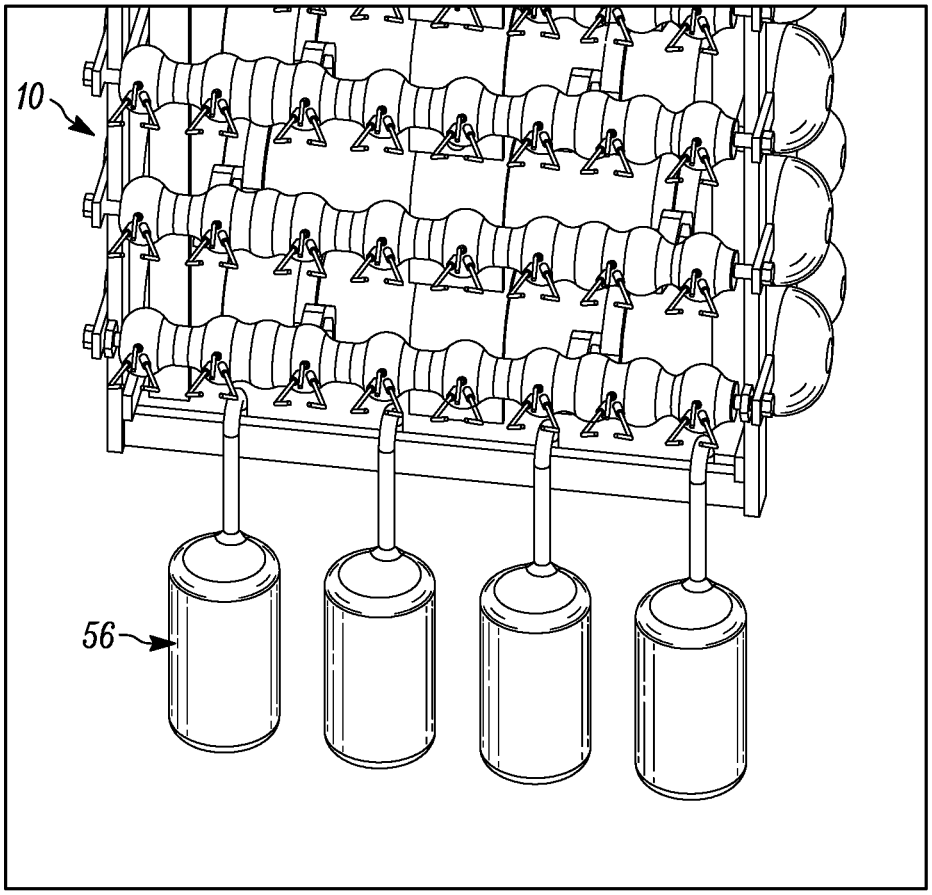
FIG. 9 is a perspective view of one embodiment of the invention depicting weights removably attached to the invention.

In certain embodiments of the present invention the fluid of the plating bath 20 is agitated to allow for better plating of the work piece 50. In such instances the agitation may cause the rack 10, when lowered into the plating bath 20, to be pushed against the wall of the plating bath 20. Such movement is undesirable as it may prevent the support arm 26 from moving properly, resulting in a work piece 50 that is not adequately plated. To prevent such movement, one or more weights 56 may be removably attached to the bottom of rack 10, as shown in FIG. 9. Alternatively, the weights may be removably attached to rack 10 via a clamp, bolt, screw, hook, tie or the like. Weights 56 provide additional weight to rack 10, thus preventing rack 10 from being moved when the fluid of plating bath 20 is agitated.

Although the invention has been described and illustrated with respect to the exemplary embodiments thereof, it should be understood by those skilled in the art that the foregoing and various other changes, omissions and additions may be made therein and thereto, without departing from the spirit and scope of the claimed invention.

We claim:

1. A rack for use in electroplating, said rack comprising:

one or more support arms, said one or more support arms having an axis;

wherein said one or more support arms rotate around said axis;

one or more clips affixed to said one or more support arms, each of said one or more clips further comprising a first prong;

wherein said first prong is configured to contact the interior wall of a work piece at a single contact point;

wherein said one or more clips rotate in conjunction with said one or more support arms when said one or more support arms rotate around said axis; and one or more first buoyant devices directly affixed to said one or more support arms, wherein said one or more first buoyant devices rotate in conjunction with said one or more support arms; and wherein movement of said one or more first buoyant devices causes said one or more support arms rotate around said axis.

2. The rack of claim 1, further comprising a frame having first and second side portions.

3. The rack of claim 2, wherein each of said one or more support arms has a respective first end and second end, said first end being attached to said first side portion and said second end being attached to said second side portion.

4. The rack of claim 3, wherein said first end and said second end are rotatably coupled to said first side portion and said second side portion, respectively.

5. The rack of claim 3, wherein said one or more first buoyant devices comprise closed cylindrical polymeric containers.

6. The rack of claim 3, further comprising one or more second buoyant devices, wherein said one or more second buoyant devices are removably attached to said one or more first buoyant devices.

7. The rack of claim 6, wherein said one or more second buoyant devices comprise closed cylindrical polymeric containers.

8. The rack of claim 3, comprising a movable locking bar, wherein said locking bar is situated at the top of said rack and prevents movement of said one or more support arms when said locking bar is engaged.

9. The rack of claim 1, comprising at least one weight removably attached to the bottom of said rack.

10. The rack of claim 1, wherein said one or more support arms are coated with a protective coating.

11. The rack of claim 10, wherein said protective coating comprises plastisol.

12. The rack of claim 11, wherein the thickness of said protective coating ranges from about ⅛ inch to about ¼ inch.

13. The rack of claim 8, wherein said locking bar has a raised position and a lowered position; wherein said locking bar prevents movement of said one or more support arms when said locking bar is in said lowered position; and wherein said locking bar permits movement of said one or more support arms when said locking bar is in said raised position.

14. The rack of claim 1, said rack further comprising a second prong;

wherein said second prong is configured to contact the interior wall of said work piece at a single contact point.

15. The rack of claim 14, wherein said second prong further comprises a first end and a second end; and wherein said single contact point of said second prong is situated between said first end of said second prong and said second end of said second prong.

16. The rack of claim 15, wherein said first end of said second prong, said single contact point of said second prong, and said second end of said second prong are arranged in a triangular configuration.

* * * * *